US006959830B1

(12) United States Patent
Kanou et al.

(10) Patent No.: US 6,959,830 B1
(45) Date of Patent: Nov. 1, 2005

(54) METAL CONTAINER WITH THREAD

(75) Inventors: Yoshinori Kanou, Toyama (JP); Masanori Tanaka, Toyama (JP); Takayoshi Sawada, Toyama (JP)

(73) Assignee: Takeuchi Press Industries Co., Ltd., Toyama (JP)

( * ) Notice: Subject to any disclaimer, the term of this patent is extended or adjusted under 35 U.S.C. 154(b) by 80 days.

(21) Appl. No.: 10/148,003

(22) PCT Filed: Nov. 24, 2000

(86) PCT No.: PCT/JP00/08320

§ 371 (c)(1),
(2), (4) Date: May 24, 2002

(87) PCT Pub. No.: WO01/38185

PCT Pub. Date: May 31, 2001

(30) Foreign Application Priority Data

Nov. 26, 1999 (JP) ..... 11-335771
Feb. 2, 2000 (JP) ..... 2000-025058

(51) Int. Cl.[7] ..... B65D 1/02; B65D 1/12; B65D 25/42

(52) U.S. Cl. ..... 220/288; 220/669; 215/40; 215/42; 215/44

(58) Field of Search ..... 220/288, 304, 220/669, 351; 215/40, 42, 44, 45, 351

(56) References Cited

U.S. PATENT DOCUMENTS 1,802,898 A * 4/1931 Hothersall ..... 220/288
2,337,616 A * 12/1943 McManus et al. ..... 220/288
2,384,810 A * 9/1945 Calleson et al. ..... 220/288
2,409,788 A * 10/1946 Osborne ..... 220/288
2,484,271 A * 10/1949 Coyle ..... 220/641
2,602,565 A * 7/1952 Regan ..... 215/351
2,864,528 A * 12/1958 Henchert ..... 220/806
3,198,374 A * 8/1965 Linder et al. ..... 220/669
3,837,519 A * 9/1974 Perry ..... 215/351
4,313,545 A * 2/1982 Maeda ..... 220/669
5,718,352 A * 2/1998 Diekhoff et al. ..... 220/669
5,778,723 A * 7/1998 Diekhoff ..... 72/356
6,010,026 A * 1/2000 Diekhoff et al. ..... 220/288
6,010,028 A * 1/2000 Jordan et al. ..... 220/288

FOREIGN PATENT DOCUMENTS

EP 138585 A2 * 4/1985

(Continued)

OTHER PUBLICATIONS

International Search Report for PCT/JP00/08320 dated Feb. 27, 2001.

(Continued)

*Primary Examiner*—Sue A. Weaver
(74) *Attorney, Agent, or Firm*—Rader, Fishman & Grauer PLLC

(57) ABSTRACT

A metal container with thread capable of preventing such a defect that the strength of a lower end of a mouth part and an upper end of a shoulder part of a container main body is non-resistant to a pressing force in radial and axial directions, and a part of the container may be collapsed or buckled during a capping operation where content is filled into the container and cap is fitted to the container automatically by a machine, characterized in that at least one or more inwardly curving smooth annular recessed parts(4) and at least one or more outwardly curving smooth annular projected parts(5) are formed in an area ranging from the lower end (2*a*) of the mouth part(2) of the container main body to around the upper end(3*a*) of a tapered shoulder part increasing gradually in radial direction.

5 Claims, 20 Drawing Sheets

FOREIGN PATENT DOCUMENTS

| | | | | |
|---|---|---|---|---|
| EP | 475672 A1 | * | 3/1992 | |
| JP | S56-023487 | | 3/1981 | |
| JP | S58-113634 | | 8/1983 | |
| JP | S60-075246 | | 5/1985 | |
| JP | 62-122963 | | 6/1987 | |
| JP | S62-185249 | | 11/1987 | |
| JP | 4-327146 | * | 11/1992 | ..... 220/288 |
| JP | 8-175561 | | 7/1996 | |
| JP | 9-142532 | | 6/1997 | |
| JP | H09-202341 | | 8/1998 | |
| WO | WO01/38185 | | 5/2001 | |

OTHER PUBLICATIONS

English translation of Argument from Japanese Patent Office dated Sep. 25, 2001.

* cited by examiner

METAL CONTAINER WITH THREAD

TECHNICAL FIELD

The present invention relates to a metal container with thread in which a mouth part including a threaded part and an upper end of a shoulder part have an improved strength. The present invention further relates to a metal container with thread capable of maintaining a highly airtight condition.

BACKGROUND ART

Conventionally, a metal container with thread, as shown in FIG. 19, is manufactured by drawing, drawing-and-ironing or impact forming from a metallic material such as aluminium. An open mouth part of such a metal container is closed airtight, as a cap is screwed on a threaded part formed in a periphery of the cylindrical mouth part. FIG. 19 is a cross sectional view of a conventional metal container with thread. Denoted at 50 is a container main body, and the container main body 50 is formed by a curled part 51, a mouth part 52 with a threaded part, a tapered shoulder part 53, a trunk part 54 and a bottom part 55, shown in this order from the top. A female screw of a cap 56 and a male screw of the mouth part 52 are fitted with each other, whereby the mouth part 52 of the container main body 50 is sealed up. The symbol 57 denotes packing. In such a container main body 50, as shown in FIG. 20, the shoulder part 53 is formed to have a linear cross sectional shape up to its upper end 53*a*, and the upper end 53*a* of the shoulder part 53 is continuous up to a lower end 52*a* of the mouth part.

Meanwhile, a metal container with thread as shown in FIG. 21 is known and commercially available, where plurality of protruded parts 62 (three in FIG. 21) are formed at schematic equal intervals entirely over a shoulder part 61 of a container main body 60.

However, as shown in FIG. 20, the container main body 50 shown in FIG. 19 has a problem that the strength of the lower end 52*a* of the mouth part 52 and the upper end 53*a* (area W) of the shoulder part 53 is weak against pressure forces in a radial direction and an axial direction (pressing forces P, Q) therefore, the area W may be collapsed or buckled during a capping operation to fill content into the container and fit a cap to the container automatically using a machine.

With respect to the container main body 60 shown in FIG. 21, a purpose of forming the plurality of protruded parts 62 entirely over the shoulder part 61 is to mainly achieve a design effect of the metal container with thread and to prevent the shoulder part 61 from getting wrinkled during a necking operation of manufacturing steps. Thus, an improvement in strength at the mouth part and the upper edge of the shoulder part is not intended here, accordingly no actual enhancement of strength is expected.

On the other hand, as shown in FIG. 22, the curled part 51 is formed at the upper end of the mouth part 52 in the conventional metal container with thread to thereby ensure a better strength, safety for a user and sealable effect. In other words, by means of an axial clamping force developed as the female screw of the cap 56 is fitted to the male screw of the mouth part 52, the packing 57 laid on an inner ceiling surface of the cap 56 abuts on a top surface of the curled part 51 formed at the upper end of the mouth part 52, whereby an opening at the mouth part 52 is sealed up. A lower end 56*a* of the cap 56 is bent along a bead part (annular groove) 52*b* formed in the mouth part 52 and fitted with the upper area of the bead part to its end.

However, since the packing 57 and the ceiling surface of the curled part 51 are in surface contact, such a dosing structure has a problem with a sealing capability if the curled part 51 has a slight dimensional error and the surface contact is accordingly weak. In short, when content develops an internal pressure, the content may leak out between the packing 57 and the ceiling surface of the curled part 51. Particularly, as for a metal container containing, a carbonated beverage such as beer and cola, it is required that the metal container is sealed up without fail again after opened once, do that the quality and the internal pressure of the remaining contained drink are maintained, so that an insufficient sealing capability becomes a problem.

An attempt to improve a sealing capability by strongly tightening the cap 56 and increasing applied pressure between the packing 57 and the curled part 51 to one another invites the area W at the upper end of the shoulder part 53 shown in FIG. 20 to twist more, and therefore, makes it easier for the area W to be buckled. If the tightening force is reduced to prevent such buckling, leakage tends to occur.

On the other hand, in a conventional metal container, an area of the bead part 52*b* easily collapses when lower end 56*a* of the cap 56 is plastically deformed along the bead part 52*b* in the manner as shown in FIG. 22. Further, the cap 56 may be a screw cap with preformed thread or a roll-on type cap put on the mouth part 52 to be pressurized along the male screw of the mouth part to thereby form threads. In the latter case, a side wall of the cap 56 is pressed strongly in the radial direction toward inside, and therefore, the threaded part may easily collapse.

In addition, where the metal container shown in FIG. 19 uses a cap such as a Pilfer Proof cap (PP cap) and a similar Alten cap (also known as a flavor cap a high-lock cap), to be fractured as opened in order to clearly indicate a user that the container has been unopened, the threaded part, the bead part and the like collapse more easily and the upper end of the shoulder part buckles more easily, since the strength of the cap is high.

The present invention was made in view of the conventional problems described above, and accordingly, a first object of the present invention is to provide a metal container with the threaded part 52 and the lower end 52*a* of the mouth part as well as the upper end 53*a* (area W) of the shoulder part 53 having an improved strength in a radial direction and an axial direction. Further, a second object of the present invention is to provide a metal container with thread capable of maintaining a highly airtight condition.

DISCLOSURE OF THE INVENTION

A metal container with thread according to the present invention is manufactured by drawing, drawing-and-ironing or impact forming from a metallic material with container main body consisting of a mouth part including a threaded part, a tapered shoulder part, a trunk part and a bottom part and maintaining a highly airtight condition with a cap screwed on, and is characterized in that at least one or more inwardly curving smooth annular recessed parts or at least one or more outwardly curving smooth annular protruded parts are formed around an upper end of said tapered shoulder part widening in a radial direction toward below from a lower end of said mouth part. According to a preferred embodiment, both said annular protruded parts and annular recessed parts are formed. Further, a bead part for bending a lower end of said cap for engagement may be formed in the vicinity of said lower end of said mouth part.

A metal container with thread according to a second aspect of the present invention is manufactured by drawing, drawing-and-ironing or impact forming from a metallic material with container main body consisting of a mouth part including a threaded part, a tapered shoulder part, a trunk part and a bottom part and maintaining a highly airtight condition with a cap screwed on, and is characterized in that an annular rounded projection with a rounded radius of 0.2 to 0.8 mm is formed at an upper end of the mouth part so that when the cap is screwed on, the annular projection bites into packing laid on an inner surface of a ceiling surface of the cap and an air tight condition is realized.

A third aspect of the present invention is characterized in that curled part with sectional view of circle around upper end of said mouth part is formed and flat surface around outer part of this curled part is formed, thereby creating outer part of the curled part with sectional view of a straight line and inner part of the curled part with sectional view of an arc continuously around upper end of mouth part, and a bent line which appears between the outer part and inner part of upper end of the curled part forms an annular slightly rounded projection.

Fourth aspect of the present invention is characterized in that curled part with sectional view of circle around upper end of said mouth part is formed and flat surface around inner part of the curled part is formed, thereby creating inner part of curled part with sectional view of straight line and outer part of curled part with sectional view of an arc, and a bent line which appears between the outer part and inner part of upper end of the curled part forms an annular slightly rounded projection.

The container main body may be formed by integral forming so that the mouth part including the threaded part, the tapered shoulder part, the trunk part and the bottom part are integral with each other, or alternatively, the mouth part including the threaded part and a tapered neck part may be formed integral with each other to thereby form an upper container body, the side wall part and the bottom part may be formed integral with each other to thereby form a lower container body, and the upper container body and the lower container body may be joined to each other.

A fifth aspect of the present invention manufactured by drawing, drawing-and-ironing or impact forming from a metallic material; comprising container main body consisting of a mouth part including a threaded part, a tapered shoulder part, a trunk part and a bottom part; a cap which screws to the mouth part of container main body; and a packing housed inside a ceiling surface of the cap and held between ceiling surface of the cap and upper end of the mouth part, and by forming a flat surface at outer part of the curled part, a bent line to form an annular slightly rounded projection annularly between the inner part and the outer part of the upper end of the curled part is formed, and upper-side of the cap is crimped until flat surface around outer part of the curled part and packing housed inside a ceiling surface of the cap abuts each other.

DESCRIPTION OF THE PREFERRED EMBODIMENT

Figure 1:
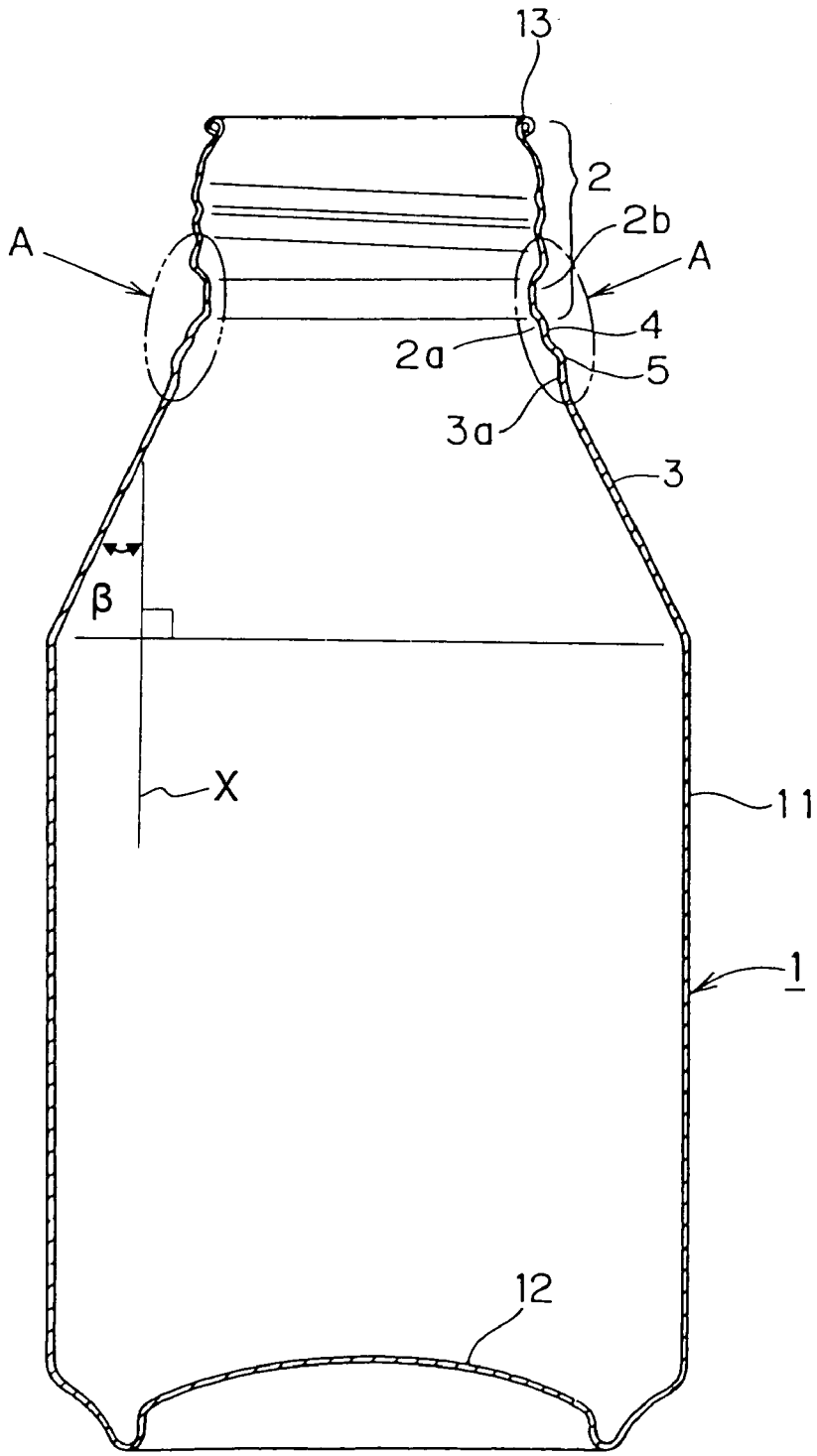
FIG. 1 is a front cross sectional view showing a first preferred embodiment of the present invention.
Figure 2:
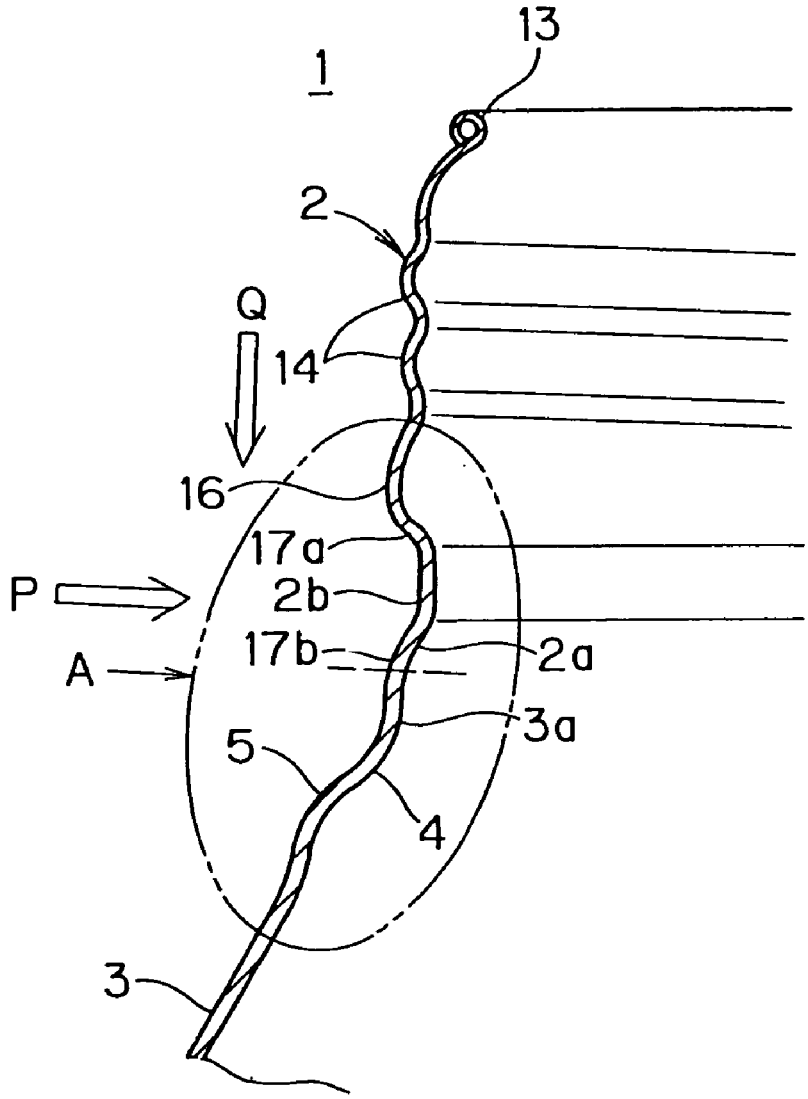
FIG. 2 is a cross sectional view showing a mouth part and an upper end of a shoulder part according to the first preferred embodiment of the present invention.
Figure 3:
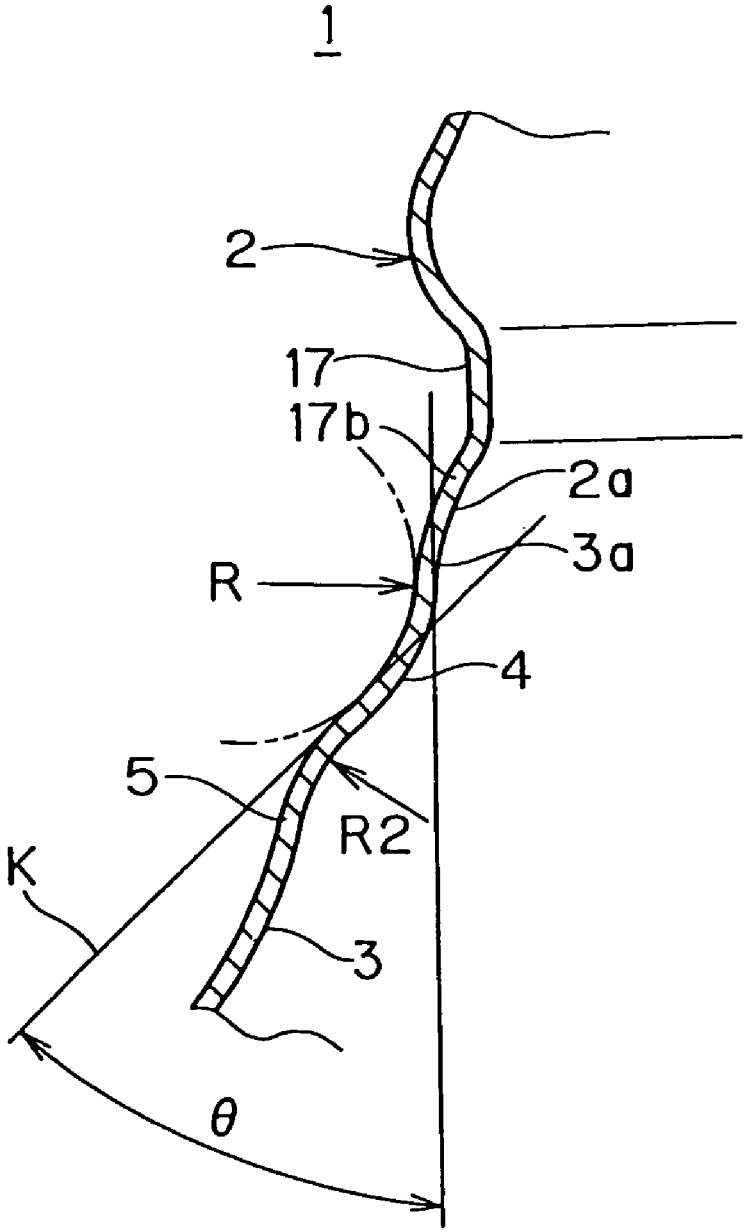
FIG. 3 is an enlarged cross sectional view showing an area A according to the first preferred embodiment of the present invention.

FIGS. 1 through 3 show a metal container with thread according to a first preferred embodiment of the present invention. A container main body 1 of this container with thread is basically approximately the same as the conventional one, and as shown in FIG. 1, comprises a cylindrical mouth part 2, a tapered shoulder part 3 downwardly contiguous from a lower end 2*a* of the mouth part 2, a trunk part 11 contiguous from a lower end of the shoulder part, and a bottom part 12 closing a lower end of the trunk part 11. As clearly shown in FIG. 2, a characteristic is that an inwardly curving smooth annular recessed part 4 is formed in an area around an upper end 3*a* of the shoulder part 3 (area A) and below this an outwardly curving smooth annular protruded part 5 is formed contiguously. A lower portion of the protruded part 5 is linearly continuous, like conventional ones. A portion in the vicinity of an upper end of the mouth part 2 has a slightly smaller diameter, and a curled part 13 curled up outwardly is formed at this upper end. FIG. 3 is a cross sectional view further enlarging the area A according to the first preferred embodiment.

The container main body 1 is obtained by drawing, drawing-and-ironing or impact forming a metallic material, such as aluminium for instance, into a cylindrical shape with bottom, thereafter forming the shoulder part and the mouth part by shoulder-drawing, a bead part 2*b* by rolling, then a threaded part, and further the curled part 13 at the upper end of the mouth part by curling part. In this embodiment, an upper portion of the container main body 1 including the mouth part 2 with the shoulder part 3 and a lower portion including the bottom part 12 are formed integral with each other.

The diameter of the mouth part 2 is approximately 35 to 40 mm, for instance, preferably about 37.8 mm, while the diameter of the trunk part 11 is approximately 60 to 70 mm, preferably about 66.0 to 66.4 mm. The thickness of a material plate is approximately 0.2 to 0.3 mm, for example, preferably about 0.21 to 0.25 mm. The plate thickness of the mouth part 2 after forming is approximately 0.3 to 0.4 mm, preferably about 0.31 to 0.35 mm. The angle β of the shoulder part 3 is approximately 25 to 30 degrees with respect to a perpendicular line X as shown in FIG. 1. The plate thickness of the shoulder part 3 is around 0.30 to 0.34 mm in the vicinity of the upper end 3*a*. Meanwhile, the plate thickness of the trunk part 11 is about 0.11 to 0.15 mm, for instance. The plate thickness of the curled part 13 is approximately 0.33 to 0.37 mm.

As shown in FIG. 2, a corrugated male screw 14 is formed by rolling and otherwise at the mouth part 2. The thread diameter of the male screw 14 is about 36.9 to 37.5 mm. A skirt part 16 with somewhat larger diameter is formed in a lower part of the mouth part 2, and the bead part 2*b* is formed below continuously. The bead part 2*b* is an annular groove and almost trapezoidal in cross section. The skirt part 16 and an upper wall 17*a* of the bead part 2*b* are, as described later, for caulking a lower end of a cap to be fractured to open, such as a Pilfer Proof cap and an Alten cap (See FIG. 13).

As shown in FIG. 3, a lower wall 17*b* of the bead part 2*b* is smoothly curved to be contiguous to the lower end 2*a* of the cylindrical mouth part, and the annular recessed part 4 is downwardly contiguous from the upper end 3*a* of the contiguous shoulder part to the lower end 2*a*. The recessed part 4, in its cross section, preferably has a radius of curvature R of about 0.5 to 5 mm, and more preferably, approximately 2 to 4 mm. The angle of inclination (i.e., the degree of curve) θ of a common tangent line K of the recessed part 4 and the protruded part 5 is preferably about 35 to 60 degrees, and more preferably, approximately 40 to 50 degrees.

Figure 4:
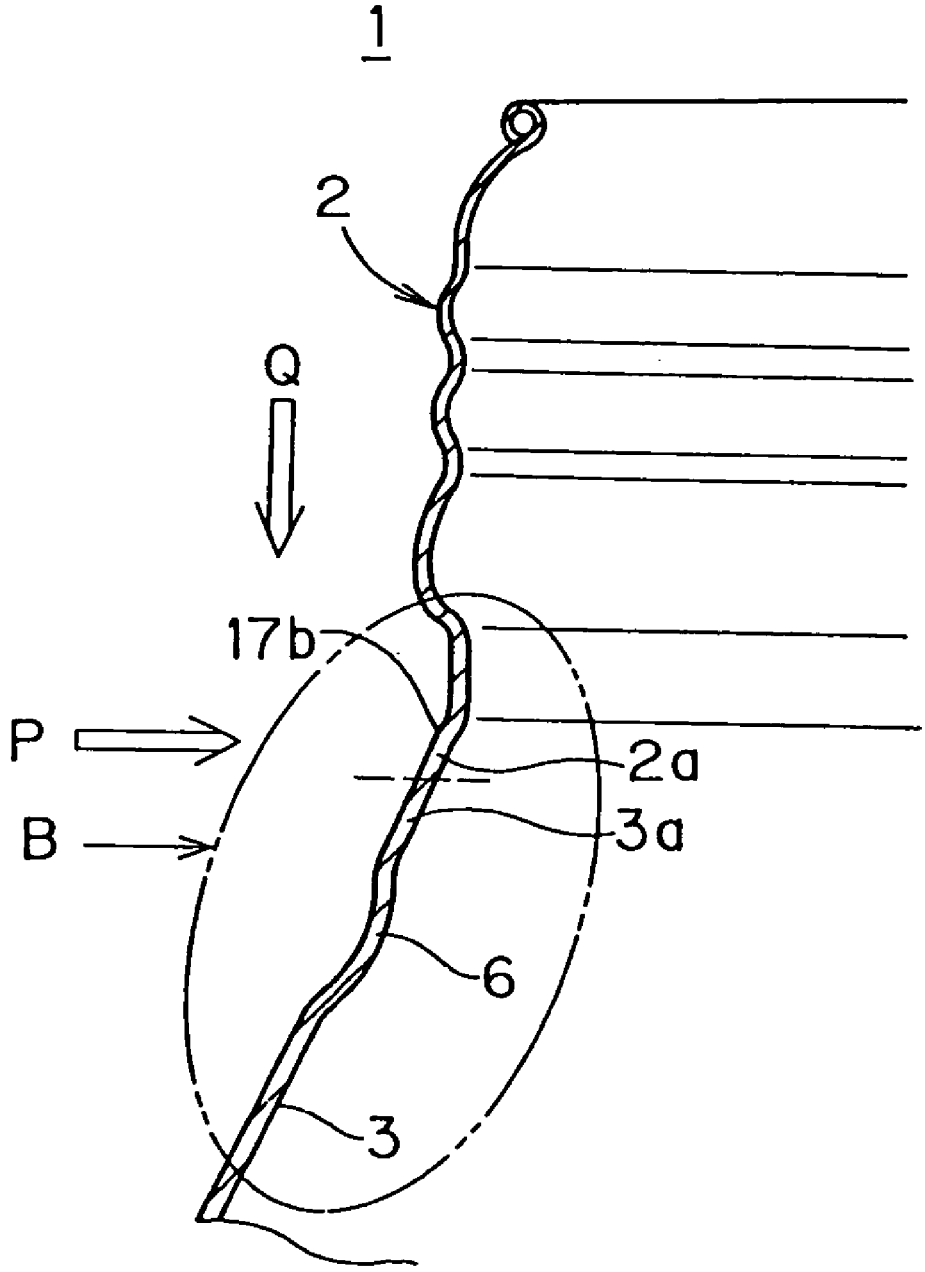
FIG. 4 is a cross sectional view showing a mouth part and an upper end of a shoulder part according to a second preferred embodiment of the present invention.

FIG. 4 shows a metal container with thread according to a second preferred embodiment of the present invention. The container main body 1 of this metal container is characterized in that one inwardly curving smooth recessed part 6 is formed in a portion around the upper end 3*a* of the shoulder part (area B). The protruded part 5 of FIG. 3 is not formed. The lower wall 17*b* of the bead part 2*b* is contiguous to the upper end of the shoulder part 3 while remaining inclined, and the recessed part 6 is formed somewhat below this. The recessed part 6 preferably has approximately the same radius of curvature, width and depth as the recessed part 4 according to the first preferred embodiment shown in FIG. 3.

Figure 5:
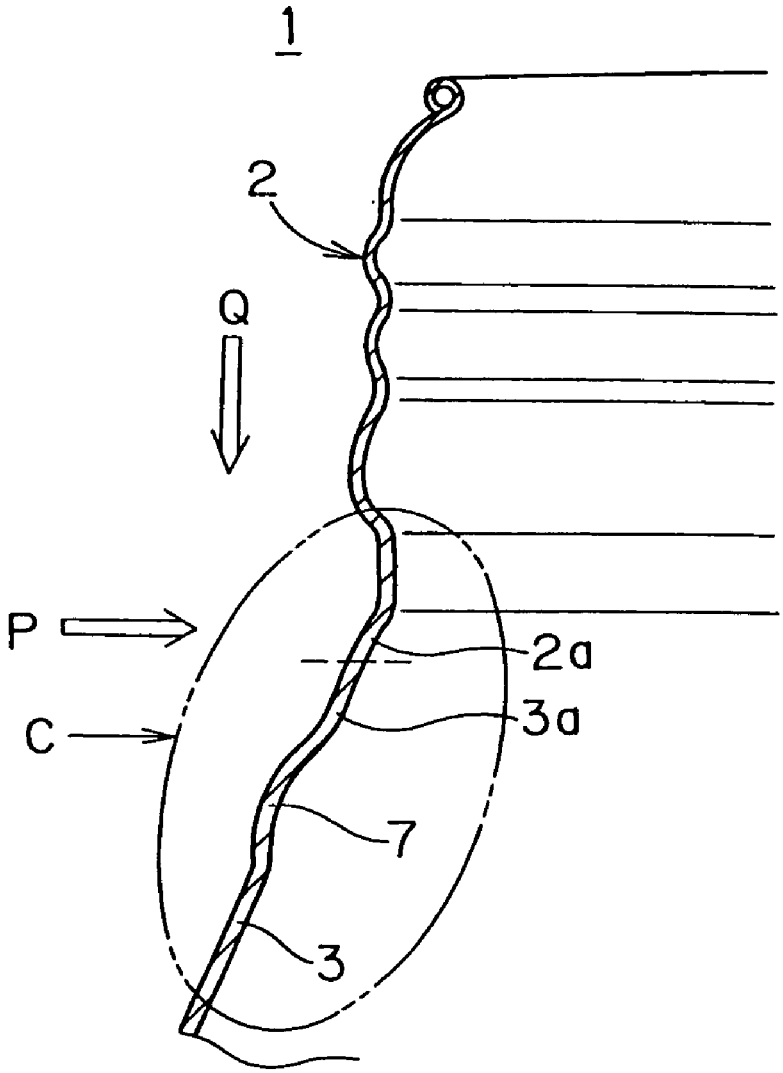
FIG. 5 is a cross sectional view showing a mouth part and an upper end of a shoulder part according to a third preferred embodiment of the present invention.

FIG. 5 shows a metal container with thread according to a third preferred embodiment of the present invention. The container main body 1 of this metal container is characterized in that one outwardly curving smooth protruded part 7 is formed in a portion around the upper end 3*a* of the shoulder part 3 (area C) continuous to the lower end 2*a* of the mouth part. No recessed part is formed. The protruded part 7 preferably has approximately the same cross sectional shape and angle of gradient (i.e., the degree of curve) as the protruded part 5 according to the first preferred embodiment.

Figure 6:
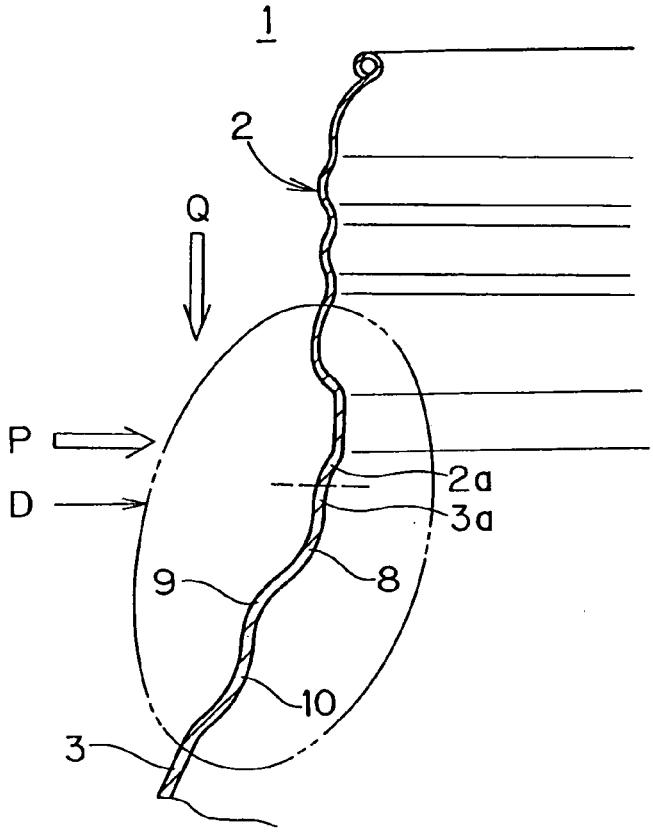
FIG. 6 is a cross sectional view showing a mouth part and an upper end of a shoulder part according to a fourth preferred embodiment of the present invention.

FIG. 6 shows a metal container with thread according to a fourth preferred embodiment of the present invention. The container main body 1 of this metal container is characterized in that an inwardly curving smooth recessed part 8 is formed in a portion around the upper end 3*a* of the shoulder part 3 (area D) continuing to the lower end 2*a* of the mouth part, and continuously an outwardly curving smooth protruded part 9 is formed, and further continuously an inwardly curving smooth recessed part 10 is formed. In other words, the two recessed parts 8 and 10 and one protruded part 9 are formed alternately in the area D. As another preferred embodiment, two recessed parts and two protruded parts may be formed alternately (not shown).

Next, an effect of the metal containers with thread above is described. In the metal containers with thread according to the first to the fourth preferred embodiments, since the areas A, B, C and D are each bent to form the recessed parts and/or the protruded parts, the strength against pressing forces P and Q respectively in a radial direction and an axial direction improves. The radius of curvature R and the angle of inclination θ of the recessed parts and/or the protruded parts may be larger than the ranges described above. In the case that these values are larger, however, the strength against the pressing force P in the radial direction is stronger, while the strength against the pressing force Q in the axial direction is weaker. Hence, to improve in strength against both the pressing forces P and Q, the recessed parts described above preferably have the radius of curvature R of about 0.5 to 5 mm and the angle of θ of about 35 to 60 degrees.

Embodiment

Figure 7:
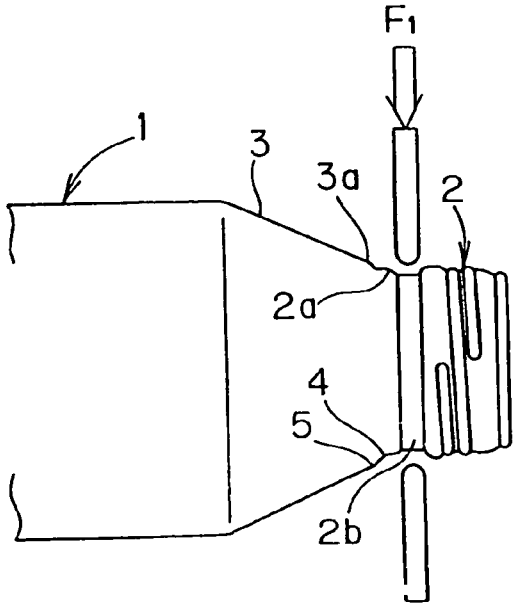
FIG. 7 is an elevational view showing a crush strength test on a bead part of a metal container with thread according to the present invention.
Figure 8:
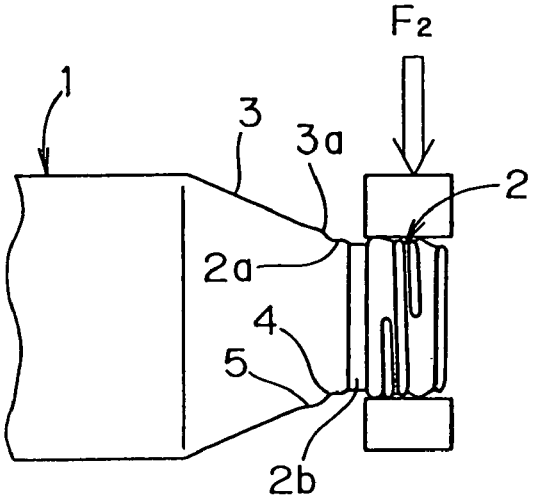
FIG. 8 is an elevational view showing a crush strength test on a threaded part of a metal container with thread according to the present invention.
Figure 9:
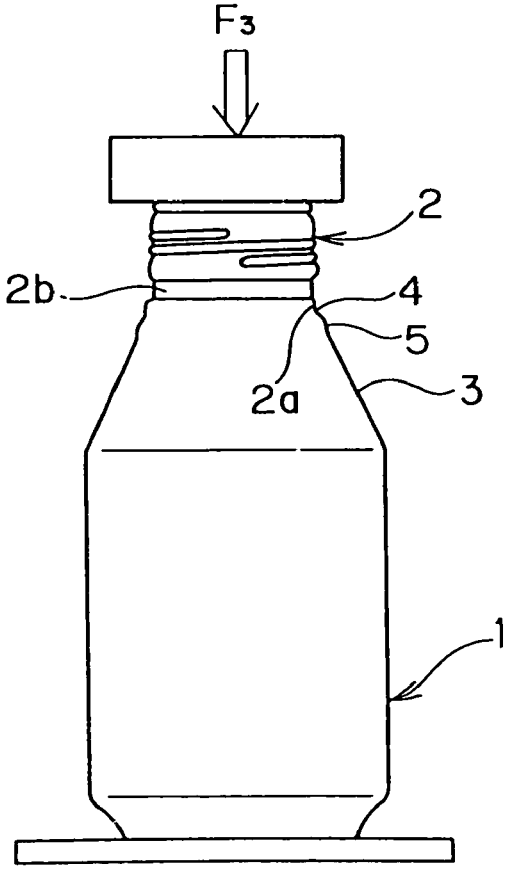
FIG. 9 is an elevational view showing a buckling strength test on a shoulder part of a metal container with thread according to the present invention.

The following describes test results comparing the strength of the mouth part and the upper end of the shoulder part between the metal container with thread comprising the recessed part 4 and the protruded part 5 (Embodiment) according to the first preferred embodiment of the present invention and a conventional metal container with thread not comprising a recessed part or a protruded part (Comparison). FIG. 7 shows a test for measuring a crush condition of the bead part 2*b* of the mouth part 2 when pressurized with a pressing force F1 from above, FIG. 8 shows a test for measuring a crush condition of the threaded part when pressurized the mouth part 2 from above with a pressing force F2, and FIG. 9 shows a test for measuring a buckling strength when pressurized the upper end of the mouth 2 from above in the axial direction with a pressing force F3.

Test Condition

The outer diameter of the container: 66 mmø. The height of the container: 166 mm. The outer diameter of the mouth part: 37.8 mmø. The thickness of the threaded part and the bead part: 0.32 mm. The thickness of the lower end of the shoulder part: 0.2 mm. The thickness of the trunk of the container: 0.15 mm. The test results are as shown in Table 1.

TABLE 1

| | The number of testing n = 2 | | |
|---|---|---|---|
| | Crush Strength of Bead Part (N) | Crush Strength of Threaded Part (N) | Buckling Strength of Shoulder Part (N) |
| Comparison | 113 | 137 | 1451 |
| Embodiment | 167 | 142 | 1657 |

From the test results above, it is found that with respect to the metal containers with thread according to the present invention, the crush strength of the bead part improves 47.8%, the crush strength of the threaded part improves 3.6% and the buckling strength of the shoulder part improves 14.2%.

As described above, the present invention has an effect to improve the strength in an area around the mouth part of the metal container with thread, and particularly in an area from the lower end of the threaded part to the upper end of the shoulder part.

Figure 10:
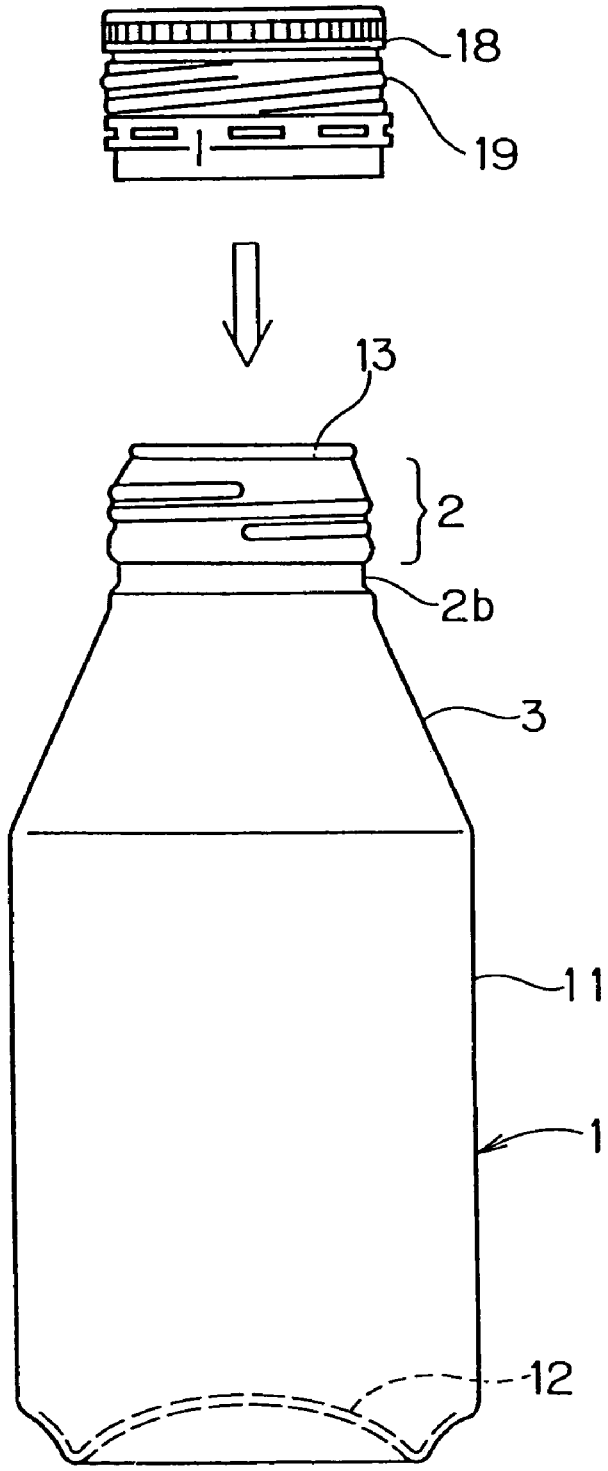
FIG. 10 is an elevational view showing a metal container with thread according to the present invention forming a mouth part, a shoulder part, a side wall part and a bottom part integrally with each other.
Figure 11:
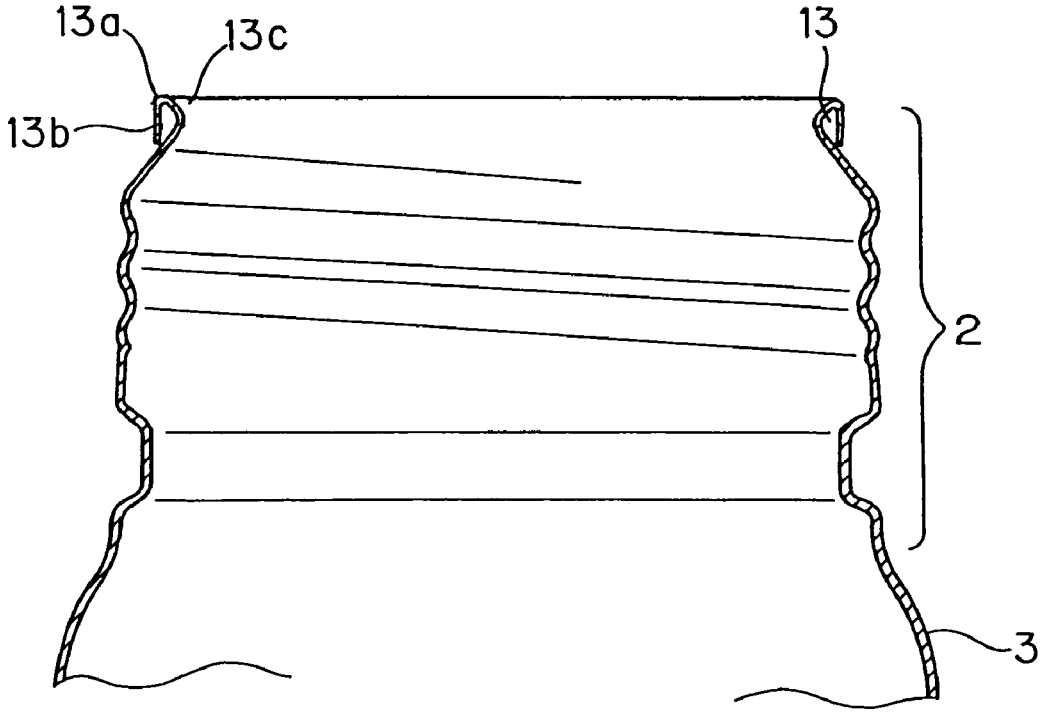
FIG. 11 is an enlarged cross sectional view showing a mouth part having a threaded part of a metal container with thread according to a fifth preferred embodiment of the present invention.
Figure 12:
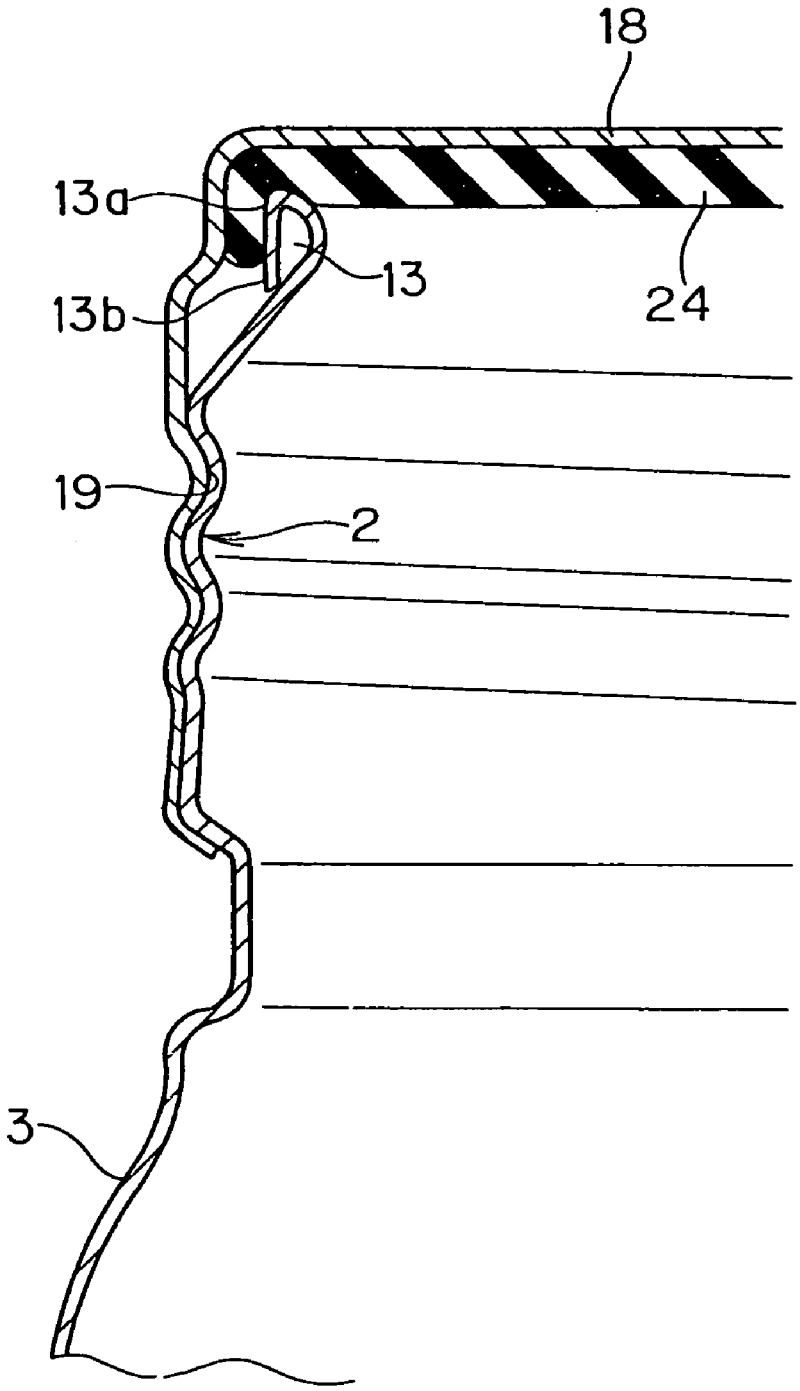
FIG. 12 is a cross sectional view showing a condition that a cap is screwed on the mouth part of the metal container with thread according to the fifth preferred embodiment of the present invention.

Next, a second aspect of the present invention is described with reference to the associated drawings. FIGS. 10 to 12 show a fifth preferred embodiment of the present invention, and a cap 18 to cover the mouth part 2 is illustrated in an upper portion of the container main body 1 therein. The cap 18 has a cylindrical shape with bottom, and a female screw 19 to engage with the threaded part of the mouth part 2 is formed in a peripheral wall. The cap 18 is a so-called Pilfer Proof cap. Other caps to be broken as opened, such as an Alten cap, may be used instead.

Figure 17:
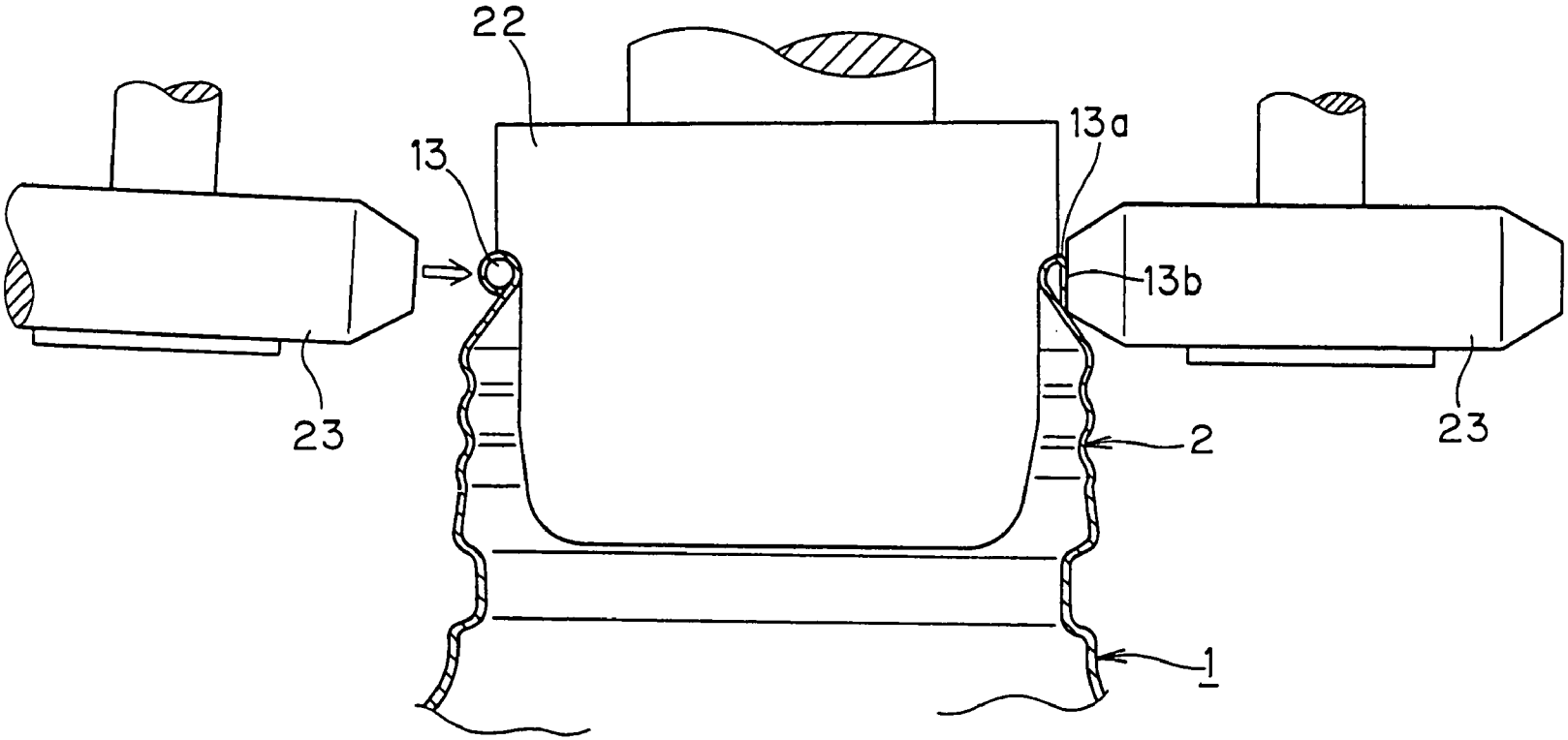
FIG. 17 is a elevational view showing manufacturing of the metal container with thread according to the fifth preferred embodiment shown in FIG. 10.

A characteristic of the fifth preferred embodiment is that an annular projection 13*a* is formed at the upper end of the mouth part 2 of the container main body 1 as shown in FIGS. 11 and 12. Other configurations are substantially the same as those shown in FIG. 1, and therefore, the same portions is denoted at the same reference symbols and is not described. In order to form the projection 13*a* at the outer upper end of the mouth part 2, first, the curled part 13 in circular-shaped cross section is formed by a normal method, such as press work using a curling die, at the upper end of the mouth part 2, a core 22 is inserted inside the container main body 1 as shown in FIG. 17, and then an outer circumferential surface of the curled part 13 is crushed with a roll 23 abutting on the curled part 13 from the outward side to thereby form a flat surface part 13*b* on the cylindrical surface approximately in parallel to the central axis of the container main body 1. As a result, as shown in FIG. 11, the projection 13*a* is created at an intersection of an inner circumferential surface 13*c* and the flat surface part 13*b* of the curled part 13 as it originally has a circular shape in cross section, i.e., along a bent line outside the upper end. The projection 13*a* is loosely curved (over about 0.2 to 0.8 mm).

Figure 13:
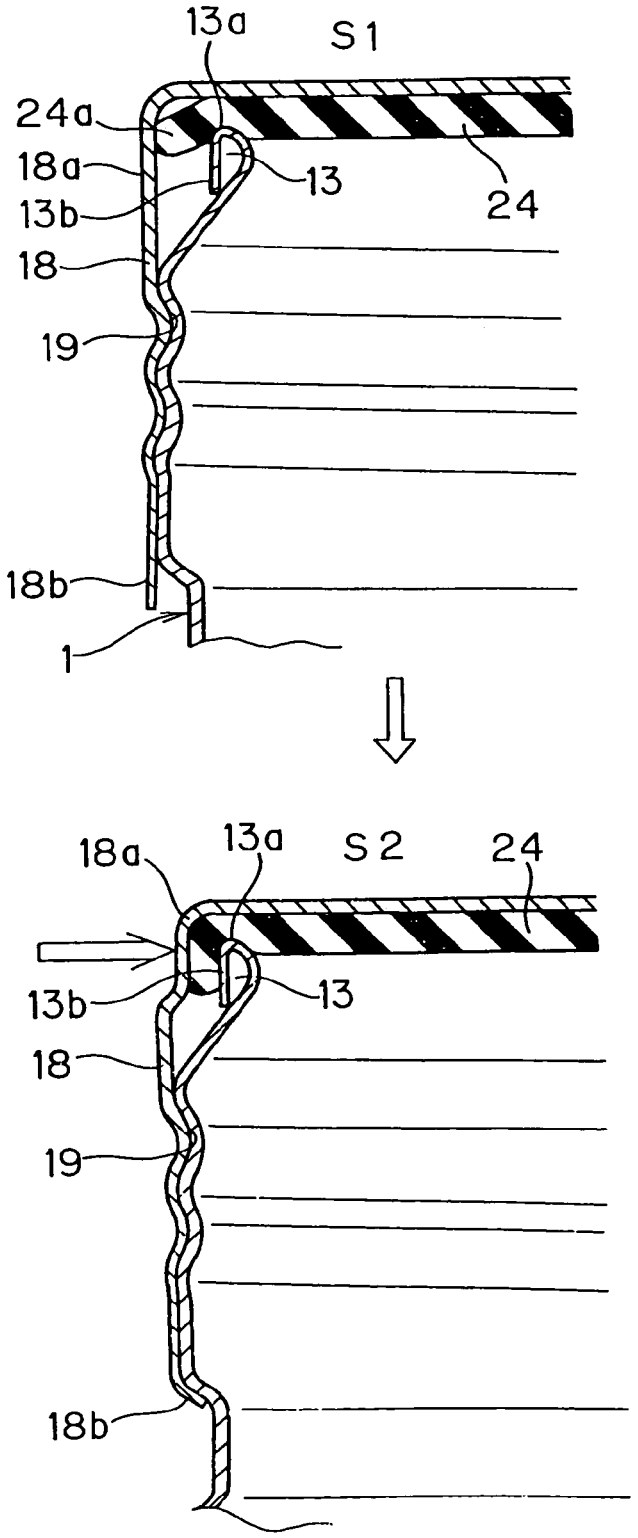
FIG. 13 is a flow chart showing a method of attaching the cap to the mouth part of the metal container with thread according to the fifth preferred embodiment of the present invention.

In order to attach the cap 18 of the Pilfer Proof type to the container main body 1 manufactured in this manner, first, as denoted at a capping step S1 shown in FIG. 13, the cap 18 is screwed on the mouth part 2 of the container main body 1. In this condition, the upper end at the outer periphery of the cap 18 is cylindrical without any stepped area created. Meanwhile, the lower end remains directly downward. Further, in this condition, there is a gap between the flat surface part 13*b* of the curled part 13 and the inner circumferential surface of the cap 18, and an outer circumferential part 24*a* of packing 24 fit inside a ceiling surface of the cap 18 expands sidewise. This however realizes a high sealable effect, since the projection 13*a* bites into the packing 24.

Following this, as denoted at a caulking step S2 shown in FIG. 13, an upper end 18*a* at the outer periphery of the cap 18 is pressurized inwardly in the radial direction, to thereby form an annular stepped part. This makes the outer circumferential part 24*a* of packing 24 bent downward and held between the flat surface part 13*b* and an inner surface of the annular stepped part. This further enhances the sealable effect. Further, a lower end 18*b* of the cap is bent inwardly and pressed against the upper wall 17*a* of the bead part 2*b*. The cap 18 is consequently fit so as not to be removed unless broken.

Figure 14:
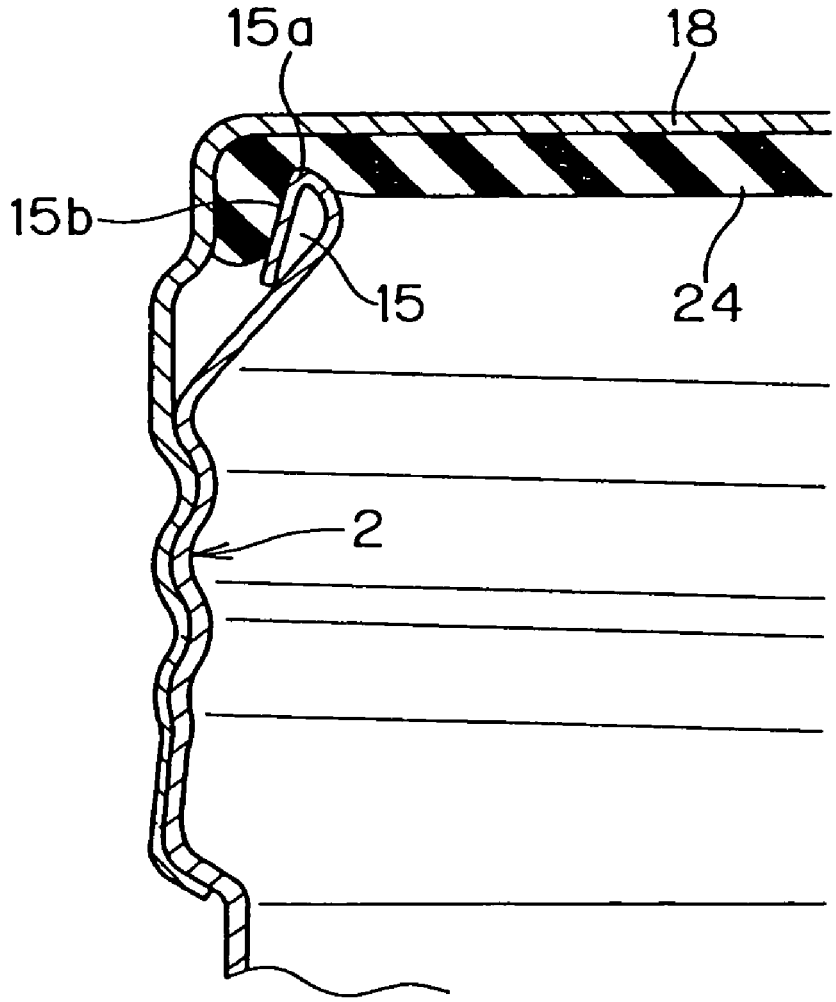
FIG. 14 is a cross sectional view showing a condition that a cap is screwed on a mouth part of a metal container with thread according to a sixth preferred embodiment of the present invention.

According to a sixth preferred embodiment shown in FIG. 14, a curled part 15 is applied crushing so as to be inclined at a certain angle with respect to the central axis of the container main body 1, and a flat surface part 15*b* is accordingly created. At an intersection of the flat surface part 15*b* and the curled part 15, approximately right above the curled part 15, a projection 15*a* is formed. The projection 15*a* is loosely curved (with a radius of about 0.2 to 0.8 mm).

Figure 15:
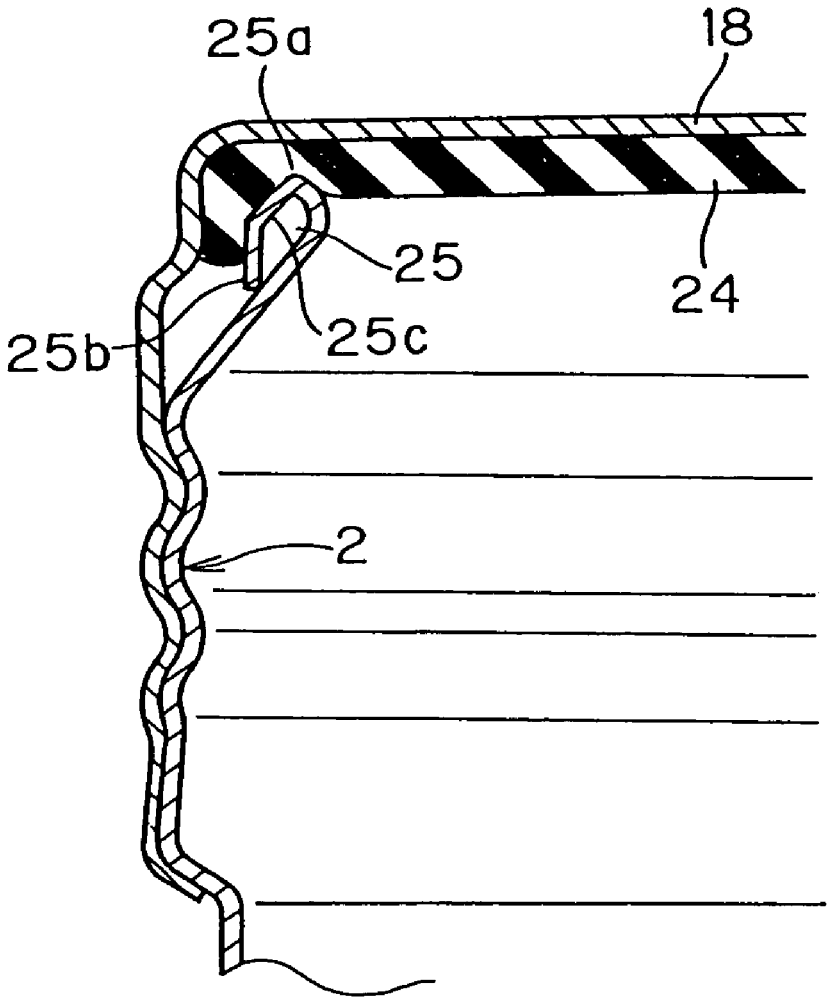
FIG. 15 is a cross sectional view showing a condition that a cap is screwed on a mouth part of a metal container with thread according to a seventh preferred embodiment of the present invention.

According to a seventh preferred embodiment shown in FIG. 15, after forming a flat surface part 25*b* with a cylindrical surface at an outer periphery of the curled part 25 to be approximately parallel to the central axis of the container main body 1, a flat surface part 25*c* inclined at a certain angle is further formed on the flat surface part 25*b*. Due to this, a projection 25*a* is created at an intersection of the flat surface part 25*c* and the curled part 25, approximately right above the curled part 25. The projection 25*a* is loosely curved (with a radius of about 0.2 to 0.8 mm). The inclined flat surface part 25*c* described above has a three-dimensional conical shape in reality.

Figure 16:
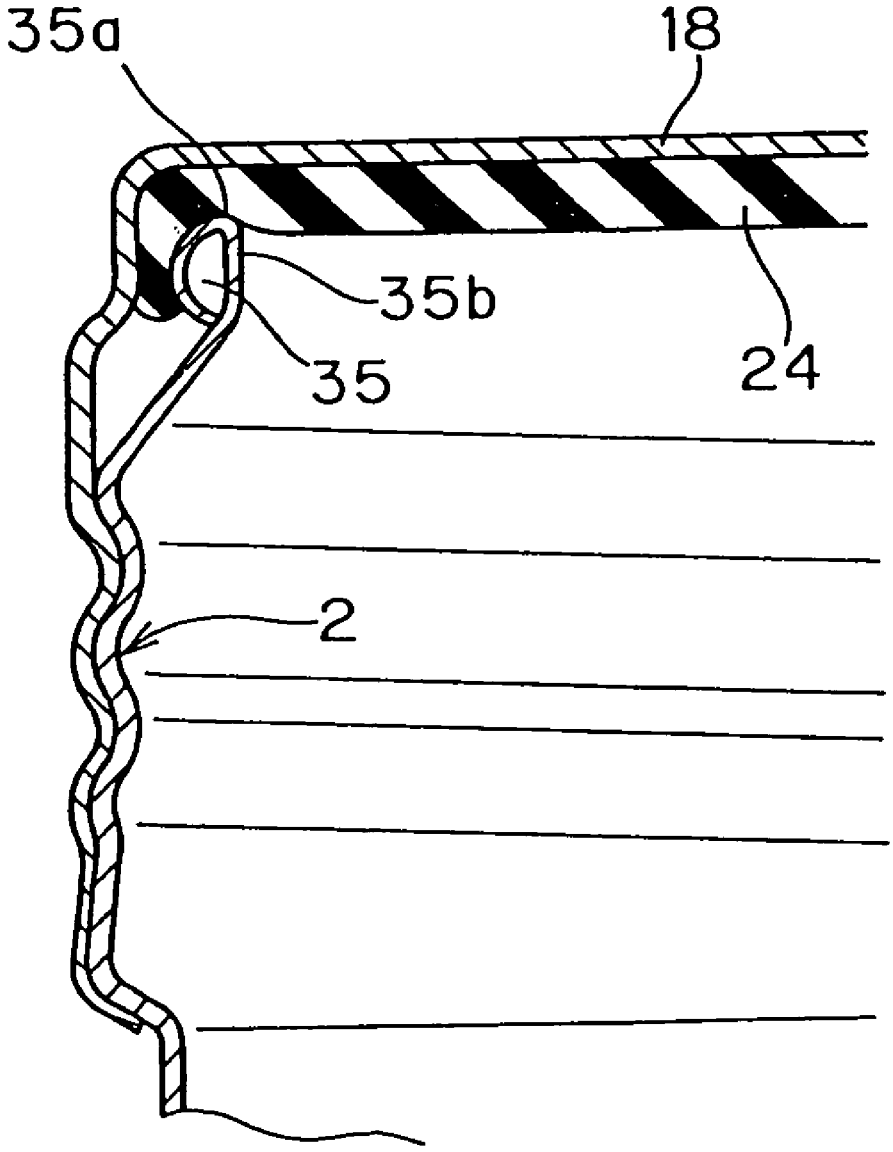
FIG. 16 is a cross sectional view showing a condition that a cap is screwed on a mouth part of a metal container with thread according to an eighth preferred embodiment of the present invention.

Further, according to an eighth preferred embodiment shown in FIG. 16, crushing applied to a curled part 35 is executed on the opposite side of the first preferred embodiment, namely, the inward side of the container main body 1, so that a flat surface part 35*b* is formed on the inward side of the curled part 35. Hence, a projection 35*a* is created at an inward upper end. The projection 35*a* is loosely curved (with a radius of about 0.2 to 0.8 mm).

Figure 18:
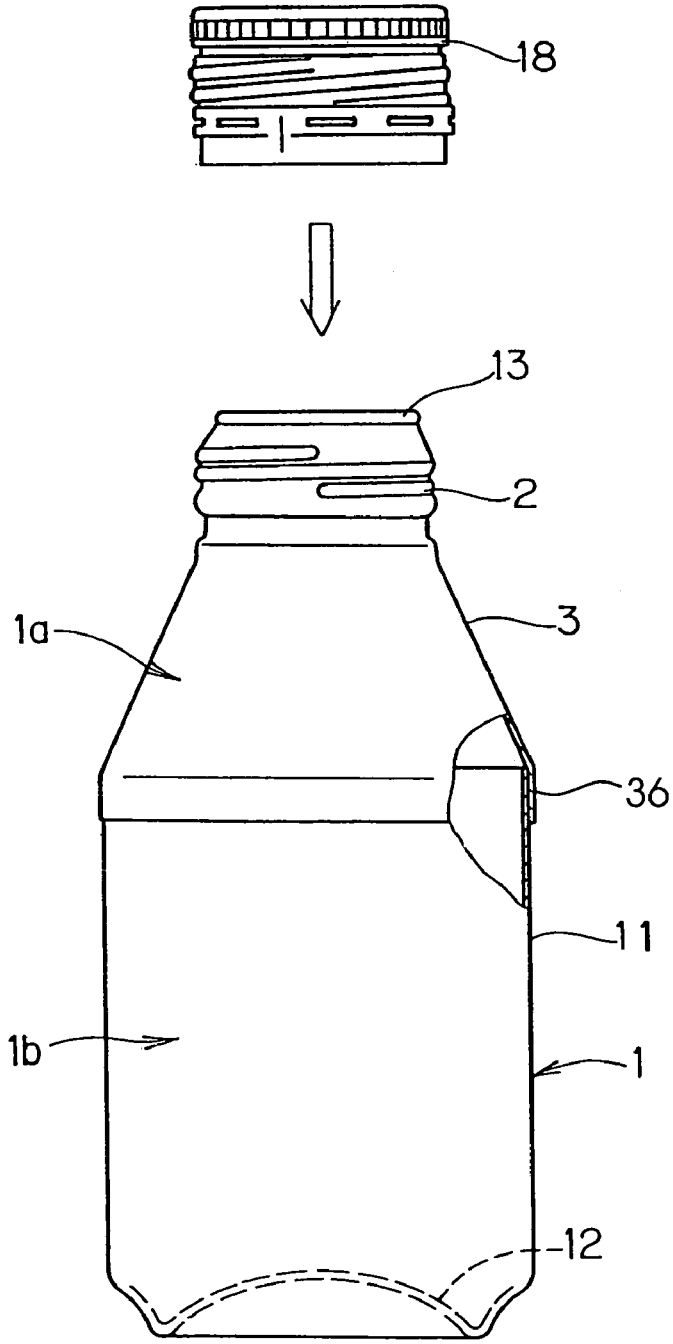
FIG. 18 is a partial cross sectional elevational view showing a metal container with thread according to other embodiment of the present invention which is obtained by bonding an upper container body to a lower container body.
Figure 19:
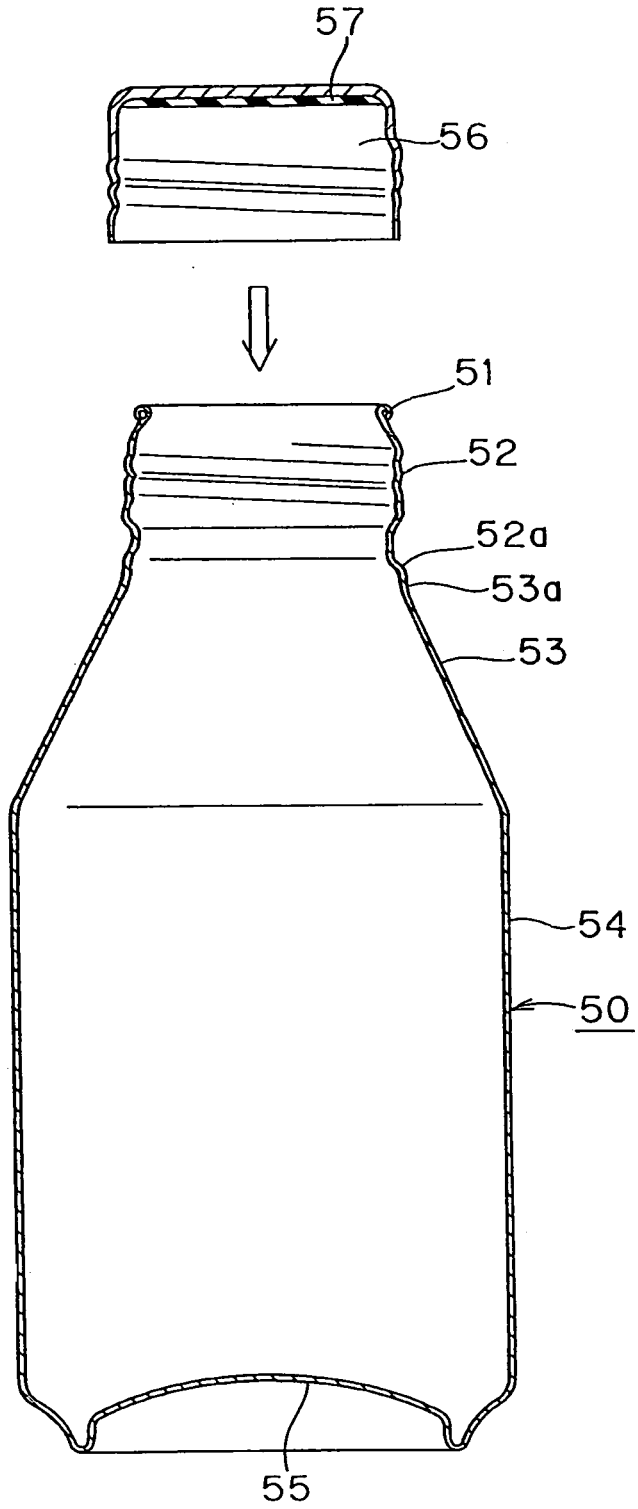
FIG. 19 PRIOR ART
FIG. 19 is a cross sectional view showing an example of a conventional metal container with thread.
Figure 20:
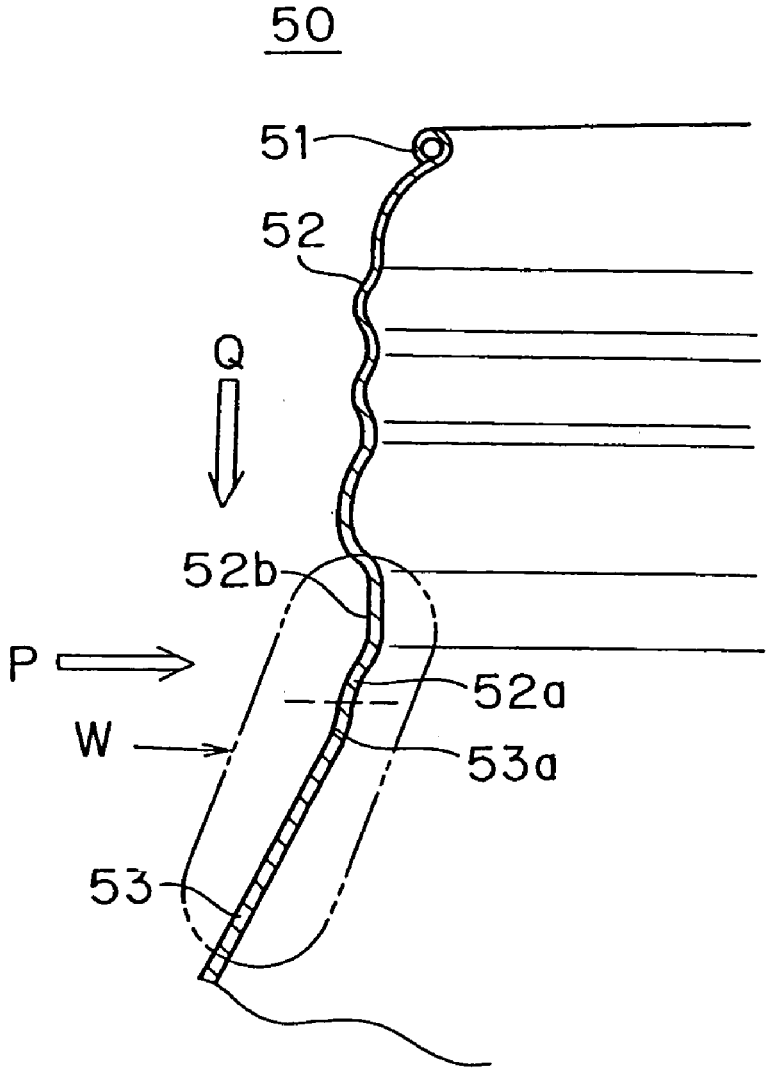
FIG. 20 PRIOR ART
FIG. 20 is a cross sectional view showing a mouth part and an upper end of a shoulder part of the metal container with thread which is shown in FIG. 19.
Figure 21:
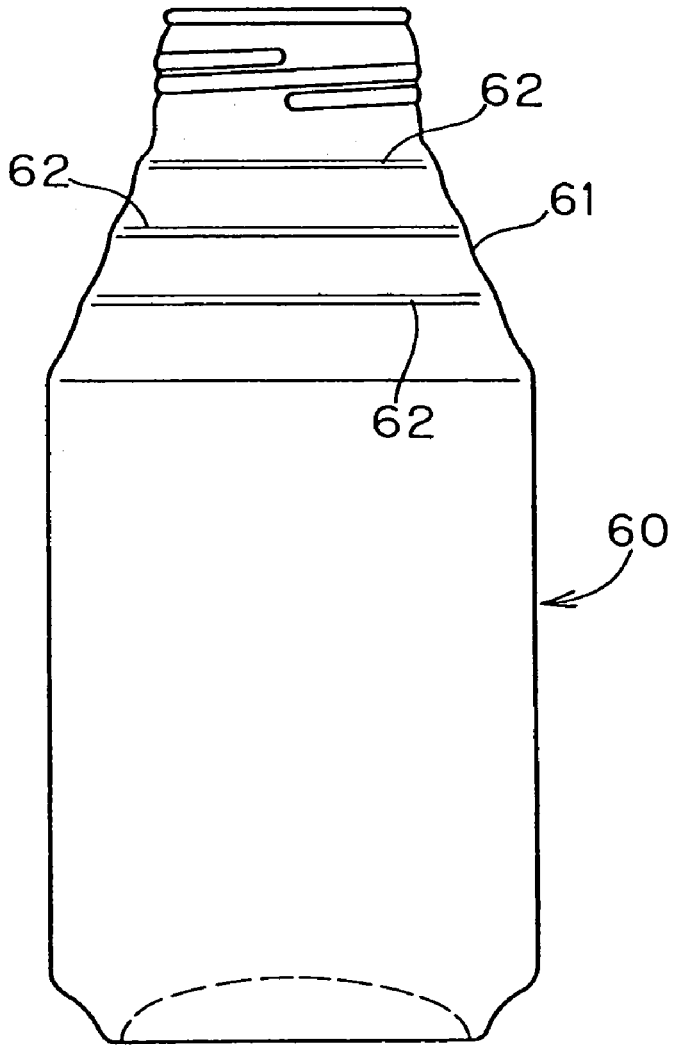
FIG. 21 PRIOR ART
FIG. 21 is a elevational view showing other example of a conventional metal container with thread.
Figure 22:
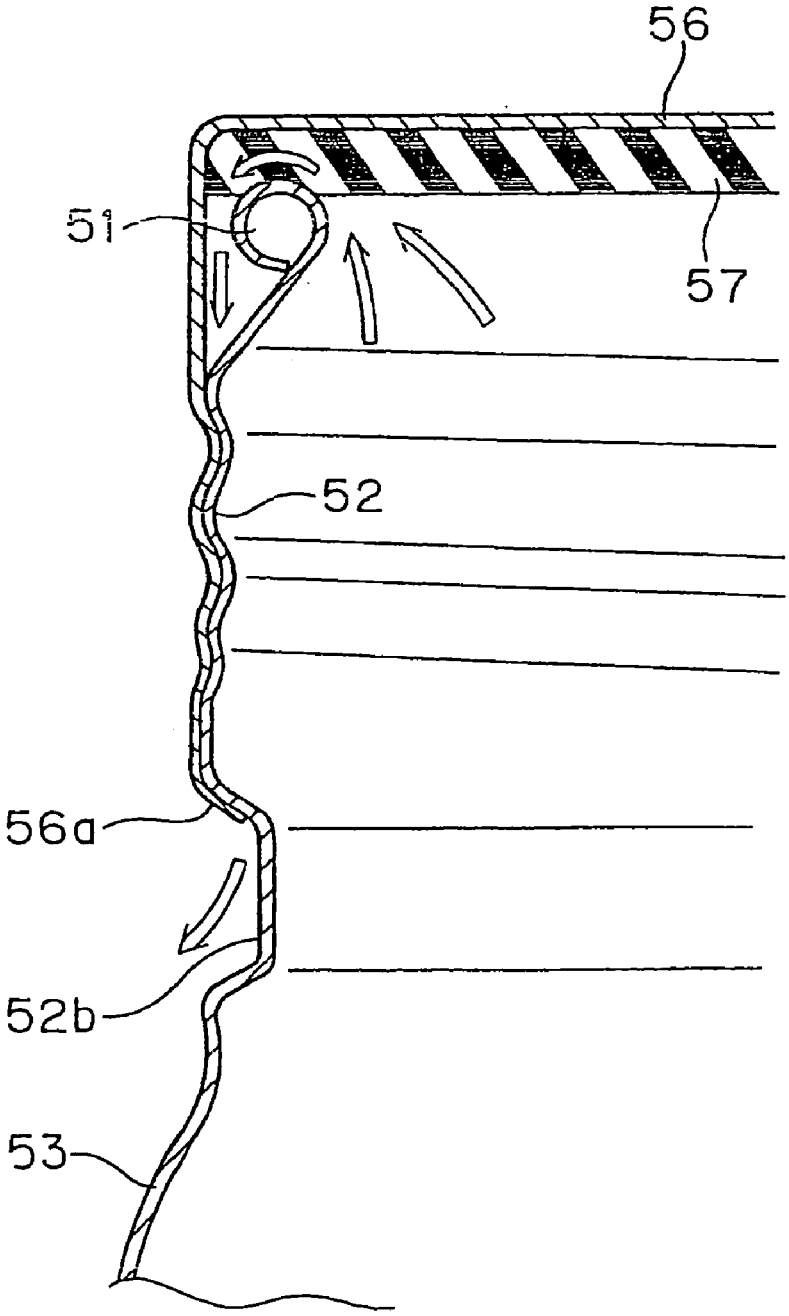
FIG. 22 PRIOR ART
FIG. 22 is an enlarged cross sectional view showing a condition that a cap is screwed on a mouth part of a conventional metal container with thread.

In any one of the preferred embodiments described above, the container main body 1 is formed as integrated one unit. However, the present invention is not limited to this. The container main body can be created by joining two or more components. The container main body 1 of the metal container with thread shown in FIG. 18 is manufactured as separate units, an upper container body 1*a* comprising the mouth part 2 and the shoulder part 3 formed integral with each other and a lower container body 1*b* comprising the trunk part 11 and the bottom part 12 formed integral with each other. A cylindrical joint part 3*b* for capping an upper end of the trunk part 11 extends at the lower end of the shoulder part 3. After forming the respective components, the joint part 3*b* is put on the upper end of the trunk part 11 and adhered with an adhesive or the like, whereby the container main body 1 is manufactured as one integrated unit. As for the upper container body 1*a*, typically, after forming the upper container body 1*a* into an upside-down cylindrical shape with bottom, the shoulder part 3 and the mouth part 2 are drawn, the upper end of the mouth part is then punched through to create an opening, and the bead part, the threaded part and the curled part 13 are thereafter formed in a manner similar to the above described. Hence, the mouth part 2 is relatively thick and has a high strength. Forming of the annular projection at the upper end of the curled part 13 and a method of the forming, etc. are the same as in the preferred embodiments described above.

Next, an effect of the seal structure above is described. In the metal containers with thread described above, since the curled parts 13, 15, 25 and 35 are created and processed to form the respective flat surface parts 13*b*, 15*b*, 25*b*, 25*c* and 35*b* as well as the projections 13*a*, 15*a*, 25*a* and 35*a* at the intersections of the curled parts and the flat surface parts, when the cap 18 is screwed on the threaded part of the mouth part 2 of the container main body 1, the projections 13*a*, 15*a*, 25*a* and 35*a* bite and fit into the packing 24 laid inside the ceiling surface of the cap 18. As a result, the opening of the mouth part 2 of the container main body 1 is sealed up without fail. In other words, at the positions where the projections 13*a*, 15*a*, 25*a* and 35*a* bite into the packing 24, the projections 13*a*, 15*a*, 25*a*, 35*a* reliably serve as annular seal points. As the cap 18 is screwed and clamps, the mouth part 2 of the container main body 1 is sealed up tightly. Hence, even if content is a beverage with an internal pressure, such as beer and cola, etc. it is possible to maintain the quality and the internal pressure of the leftover.

As described above, the present invention has an effect to prevent leakage of content at the mouth part and maintain the quality and the internal pressure of a leftover beverage without fail. In addition, since a highly airtight condition is ensured, the cap need not be tightened too strong during a capping operation, so that it is possible to prevent the shoulder part and the like of the container main body from buckling and deformation.

What is claimed is:

1. A metal container with thread manufactured by drawing, drawing-and-ironing or impact forming from a metallic material, having a container main body consisting of a mouth part with a threaded part, a tapered shoulder part, a trunk part and a bottom part and maintaining a highly airtight condition with a cap screwed on, characterized in that only one inwardly curving smooth annular recessed part is formed around an upper end of said smooth tapered shoulder part widening in a radial direction toward below from a lower end of said mouth part, wherein a bead part for bending a lower end of said cap for engagement is formed in the vicinity of said lower end of said mouth part, the bead part being an annular groove having an almost trapezoidal cross-sectional configuration, and wherein the inwardly curving smooth annular recessed part has a tangent line at its lowest end at an angle of inclination relative to a perpendicular reference line of approximately 35 to 60 degrees.

2. A metal container with thread manufactured by drawing, drawing-and-ironing or impact forming from a metallic material, having a container main body consisting of a mouth part with a threaded part, a tapered shoulder part, a trunk part and a bottom part and maintaining a highly airtight condition with a cap screwed on, characterized in that only one inwardly curving smooth annular recessed part and only one outwardly curving smooth annular protruded part are formed around an upper end of said smooth tapered shoulder part widening in a radial direction toward below from a lower end of said mouth part, wherein a bead part for bending a lower end of said cap for engagement is formed in the vicinity of said lower end of said mouth part, the bead part being an annular groove having an almost trapezoidal cross-sectional configuration, and wherein the inwardly curving smooth annular recessed part and the outwardly curving smooth annular protruded part has a common tangent line at an angle of inclination relative to a perpendicular reference line of approximately 35 to 60 degrees.

3. A metal container with thread manufactured by drawing, drawing-and-ironing or impact forming from a metallic material, having a container main body consisting of a mouth part with a threaded part, a tapered shoulder part, a trunk part and a bottom part and maintaining a highly airtight condition with a cap screwed on, characterized in that only one inwardly curving smooth annular recessed part is formed around an upper end of said smooth tapered shoulder part widening in a radial direction toward below from a lower end of said mouth part, wherein a bead part for bending a lower end of said cap for engagement is formed in the vicinity of said lower end of said mouth part, the bead part being an annular groove having an almost trapezoidal cross-sectional configuration, and wherein the inwardly curving smooth annular recessed part has a radius of curvature in a range of approximately 0.5 mm to 5.0 mm and a tangent line at its lowest end at an angle of inclination relative to a perpendicular reference line of approximately 35 to 60 degrees.

4. A metal container with thread manufactured by drawing, drawing-and-ironing or impact forming from a metallic material, having a container main body consisting of a mouth part with a threaded part, a tapered shoulder part, a trunk part and a bottom part and maintaining a highly airtight condition with a cap screwed on, characterized in that only one inwardly curving smooth annular recessed part and only one outwardly curving smooth annular protruded part is formed around an upper end of said smooth tapered shoulder part widening in a radial direction toward below from a lower end of said mouth part, wherein a bead part for bending a lower end of said cap for engagement is formed in the vicinity of said lower end of said mouth part, the bead part being an annular groove having an almost trapezoidal cross-sectional configuration, and wherein the inwardly curving smooth annular recessed part and the outwardly curving smooth annular protruded part has a radius of curvature in a range of approximately 0.5 mm to 5.0 mm and a common tangent line at an angle of inclination relative to a perpendicular reference line of approximately 35 to 60 degrees.

5. A metal container with thread manufactured by drawing, drawing-and-ironing or impact forming from a metallic material, having a container main body consisting of a mouth part with a threaded part, a tapered shoulder part, a trunk part and a bottom part and maintaining a highly airtight condition with a cap screwed on, characterized in that only one inwardly curving smooth annular recessed part or only one inwardly curving smooth annular recessed part and only one outwardly curving smooth annular protruded part is formed around an upper end of said smooth tapered shoulder part widening in a radial direction toward below from a lower end of said mouth part, wherein a bead part for bending a lower end of said cap for engagement is formed in the vicinity of said lower end of said mouth part, the bead part being an annular groove having an almost trapezoidal cross-sectional configuration, and wherein said shoulder part being oriented at an angle with respect to a perpendicular line in a range of approximately 25 to 30 degrees, and the inwardly curving smooth annular recessed parts and/or the outwardly curving smooth annular protruded part has a radius of curvature as viewed in cross-section in a range of approximately 0.5 mm to 5.0 mm.

* * * * *